US006093073A

United States Patent [19]

Brinkgreve et al.

[11] Patent Number: 6,093,073

[45] Date of Patent: Jul. 25, 2000

[54] FRIT JIG ASSEMBLY

[75] Inventors: Peter Brinkgreve, Waalre; Erwin C. A. Dekkers, Veghel, both of Netherlands

[73] Assignee: U.S. Philips Corporation, New York, N.Y.

[21] Appl. No.: 09/400,961

[22] Filed: Sep. 22, 1999

[30] Foreign Application Priority Data

Sep. 25, 1998 [EP] European Pat. Off. ..... 98203230

[51] Int. Cl.[7] ..... H01J 9/26

[52] U.S. Cl. ..... 445/45

[58] Field of Search ..... 445/45, 66

[56] References Cited

U.S. PATENT DOCUMENTS

| | | | |
|---|---|---|---|
| 3,329,422 | 7/1967 | Hajduk | 269/287 |
| 4,200,274 | 4/1980 | Turner | 269/908 |
| 4,718,203 | 1/1988 | Schweitz et al. | 51/283 |
| 5,797,234 | 8/1998 | Theodorou | 52/578 |

FOREIGN PATENT DOCUMENTS

| | | | |
|---|---|---|---|
| 2024358A | 9/1980 | United Kingdom | F16B 35/02 |

*Primary Examiner*—Kenneth J. Ramsey
*Attorney, Agent, or Firm*—Norman N. Spain

[57] ABSTRACT

A method of manufacturing a cathode ray tube employs an assembly of a frit jig and a flexible bolt for use during the aligning and sealing process of the glass cone and display screen components of a cathode ray tube. The flexibility provided by the bolt reduces the risk of damage to the glass parts of the cathode ray tube during the heat steps involved in the sealing process. Preferably, the bolt comprises a resilient metal pin that is flexible in a direction transverse to the longitudinal axis of the bolt. The bolt comprises a hollow part having a central bore with an opening and a head, the central bore extending substantially parallel to the longitudinal axis of the bolt, and the metal pin being comprised in the hollow bolt. The metal pin extends from the head through the bore over a length larger than that of the bore.

5 Claims, 1 Drawing Sheet

FRIT JIG ASSEMBLY

BACKGROUND OF THE INVENTION

The invention relates to a method of manufacturing a cathode ray tube having a cone part and a screen part, the method comprising the steps of aligning the cone part with respect to the screen part, sealing the cone and screen parts together, said sealing process comprising at least a cooling step.

A frit jig assembly comprising alignment means for supporting a cone part of a cathode ray tube is known from U.S. Pat. No. 3,329,422, in which a sealing frit jig is provided to minimize or avoid relative movement of the parts during the sealing process. In known manufacturing methods of sealing the display screen to the one part of the cathode ray tube, the cone part is positioned in the sealing frit jig. Next an enamel paste is applied to the edge of the cone part, and the display screen is placed onto the cone. Hereafter a heating step of about 440° C. occurs to form a proper seal between the display screen and the cone part.

It is important that the display screen and the cone part are correctly positioned with respect to each other. To achieve this the sealing frit jig is provided with alignment pins. These alignment pins are applied at three points at the outer circumference of the cone part as well as at the circumference of the display screen.

The alignment pins comprise metal and therefore have a coefficient of thermal expansion different from the glass from which the screen and the cone parts have been made. The disadvantage of this method is that during the cooling phase of the device the glass tube scratches along the alignment pins and consequently becomes damaged. This damage may lead to weak spots in the tube and during the evacuation process of the tube, the tube might implode. It has been proposed to use a soft material for the pins, for example graphite, which does not damage the tube. However, such a material has the drawback that it easily wears off and consequently a frequent adjustment and position correction of the alignment pins is necessary. Another drawback of graphite is that it might introduce unwanted contaminating particles into the display tube.

SUMMARY OF THE INVENTION

It is an object of the invention to provide an improved manufacturing method, which reduces the risk of damaging the tube during the selling process.

According to a first aspect of the invention a method of manufacturing a cathode ray tube comprising a cone part and a screen part comprises:

aligning the cone part with respect to the screen part while employing a flexible alignment means comprising a flexible bolt and sealing the thus aligned screen and cone parts together, which sealing step comprising at least a cooling step.

The method of Claim 3 has the advantage that the bolt can be applied in the existing sealing frit jig without the requirement of adaptations to the frit jig. In cathode ray tube factories commonly a large number of sealing frit jigs is used, hence the introduction of the flexible bolt may take only a limited financial investment. Furthermore, the introduction of the flexible bolt only requires a replacement of the present alignment means with a very simple operation. This operation can be carried out without additional tools or training to the executing technician.

Further, the bolt comprises cheap basic constructing elements, which are easy to be purchased, whereas the assembly of the bolt can be done with the usual equipment. This implies a low cost price of the flexible bolt.

Preferably, the hollow bolt comprises stainless steel and the metal pin comprises a nickel alloy. The material properties of the metal pin, in particular the elastic modulus, determine the bending characteristics of the metal pin. A careful optimization of this property is important. In case the metal pin is too stiff, the bolt might cause scratches to the glass parts. Whereas on the other hand, if the metal pin is too resilient the required functionality is not obtained either, which also might lead to scratches. In practice good results were obtained with a metal pin comprising a nickel alloy.

Advantageously the metal pin comprises a bush that is attached at a free end of the metal pin. The bush increases the contact surface between the metal pin and the glass parts of the tube and in this way prevents the occurrence of scratches on the glass. Good results were obtained with a bush comprising an iron alloy, but many metals or alloys thereof appear to be suitable.

U.S. Pat. No. 4,718,203 describes centering units for working the sealing edge of a cone portion of a cathode ray tube. Each centering unit comprises four resilient supporting elements. Each supporting element comprises two supporting pins, which are connected to bushings. In contrast to our invention these supporting pins are rigid. Said bushings are connected to arms. The bushings are rotatably journalled on a shaft. The arms are subject to springs, which tend to rotate the arms. The arms are provided with a recess and are slidable with respect to a rod, which is displaceable in the axial direction. On the rod friction discs are journalled on each side of the arms.

The flexibility of the centering unit as described above is obtained by means of a complicated mechanical construction. Such a construction is expensive and due to its complexity might be subject to mechanical failure and wear.

In the present invention a device is provided in which the required flexibility is obtained in a much more simple and elegant way.

DETAILED DESCRIPTION OF THE INVENTION

Figure 1:
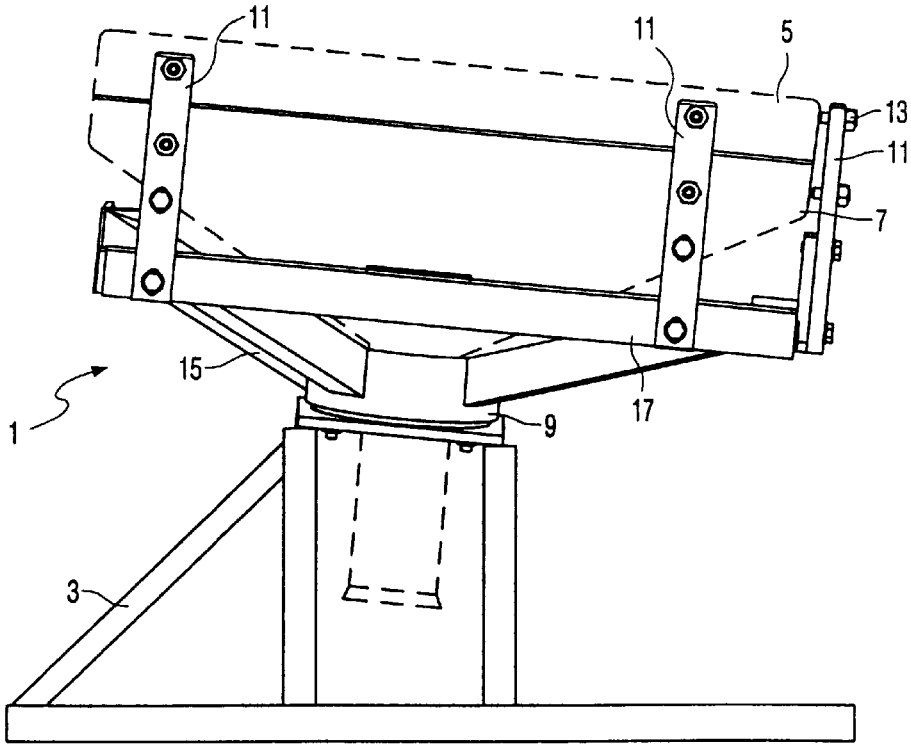
FIG. 1 is a side elevation, of a preferred embodiment of an assembly of a frit jig comprising the flexible bolt.

In general like reference numerals identify like elements.

These and other aspects of the invention will be elucidated with reference to the embodiments described hereinafter and the figures of the drawing.

The sealing frit jig 1 shown in FIG. 1 comprises a supporting frame 3 for supporting and aligning the assembly of the display screen 5 and the cone part 7 during the sealing process. The display screen 5 and the cone part 7 are indicated in dashed lines. Arms 15 extend upwardly from an annular seat 9, in which the cone part 7 is accommodated. Connected to the arms 15 are members 17 (only one shown), which comprise metal strips 11. Each metal strip 11 comprises two flexible bolts 13 for aligning the display screen 5 and the cone part 7. An arm, which is not shown in the Figure, positions the display screen 5 and the cone part 7 against the flexible bolts 13 and keeps the position of the display screen 5 and the cone part 7 fixed during the sealing process.

Figure 2:
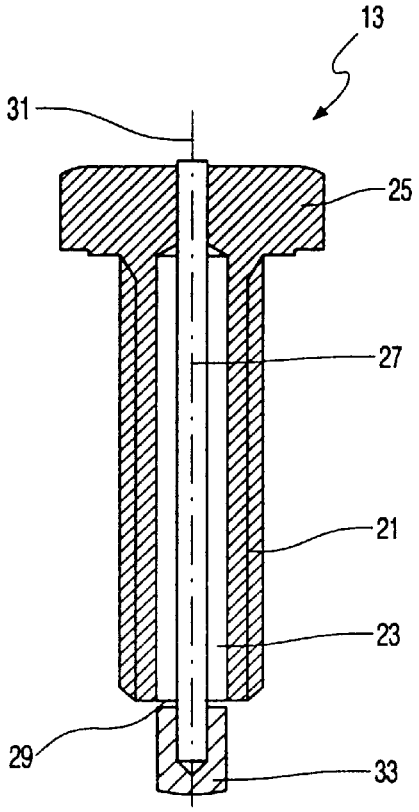
FIG. 2 is a longitudinal cross section of a preferred embodiment of a flexible bolt.

FIG. 2 shows a cross-section of a preferred embodiment of the flexible bolt 13. The flexible bolt 13 comprises a hollow part 21 with a central bore 23, an opening 29 and a head 25. The central bore 23 extends substantially parallel to a longitudinal axis 31 of the bolt 13.

A resilient metal pin 27 that is flexible in a direction transverse to the longitudinal axis 31, has been fixed to the head 25 with a usual connection method, for example by means of laser welding. The resilient metal pin 27 extends from the head 25 through the bore 23 over a length larger than that of the bore 23.

Preferably, the metal pin 27 comprises a bush 33 that is attached at the free end of the metal pin 27. The bush 33 increases the contact area between the metal pin 27 and the display screen 5 and the cone part 7. Hence, the bush 33 serves as a protection cap to prevent any damage to the glass display screen 5 and cone part 7. The bush 33 may comprise any suitable metal to serve its goal and is connected to the metal pin 27 by any suitable connection method, for example soldering or welding.

The hollow bolt 13 may comprise stainless steel whereas a suitable materials choice for the metal pin 27 is a nickel alloy, consisting for example of 70% nickel, about 5% chromium, around 6% iron and smaller quantities of additional elements, like titanium, niobium, carbon. Such an alloy yields a metal pin 27 having an elastic modulus, required for the proper bending characteristics of the metal pin 27.

In summary the invention relates to a method of manufacturing a cathode ray tube by means of an assembly of a frit jig 1 and a flexible bolt 13 for use during the aligning and sealing process of the glass cone 7 and display screen 5 components of a cathode ray tube. The flexibility provided by the bolt 13 reduces the risk of damage to the glass parts 5,7 of the cathode ray tube during the heat steps involved in the sealing process. Preferably, the bolt 13 comprises a resilient metal pin 27 that is flexible in a direction transverse to the longitudinal axis 31 of the bolt 13. The bolt 13 comprises a hollow part 21 having a central bore 23 with an opening 29 and a head 25, the central bore 23 extending substantially parallel to the longitudinal axis 31 of the bolt, and the metal pin 27 being comprised in the hollow bolt 21. The metal pin 27 extends from the head 25 through the bore 23 over a length larger than that of the bore 23.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of other elements or steps than those listed in a claim.

What is claimed is:

1. A method of manufacturing a cathode ray tube comprising a cone part (7) and a screen part (5), the method comprising:

aligning the cone part (7) with respect to the screen part (5);

sealing the cone (7) and screen (5) parts together, said sealing step comprising at least a cooling step, characterized in that for the step of aligning the cone part (7) with respect to the screen part (5) a flexible alignment means comprising a flexible bolt (13) is employed.

2. A method according to claim 1, characterized in that the flexible bolt (13) comprises a resilient part (27) that is flexible in a direction transverse to the longitudinal axis (31) of the flexible bolt (13).

3. A method according to claim 2, characterized in that the flexible bolt (13) comprises a hollow part (21) having a head (25) and a central bore (23) with an opening (29), said central bore (23) extending substantially parallel to the longitudinal axis (31) of the bolt (31), and in that said resilient part (27) comprises a metal pin (27) being comprised in the hollow part (21), said metal pin (27) extending from the head (25) through the bore (31) over a length larger than that of the bore (31).

4. A method according to claim 3, characterized in that the hollow part (21) comprises stainless steel and the metal pin (27) comprises a nickel alloy.

5. A method according to claim 4, characterized in that the metal pin (27) comprises a bush (33) which is attached at a free end of the metal pin (27).

* * * * *